United States Patent [19]

Moradzadeh

[11] 4,272,599

[45] Jun. 9, 1981

[54] INK DEVELOPMENT OF ELECTROSTATIC IMAGES

[75] Inventor: Yaqub Moradzadeh, Saratoga, Calif.

[73] Assignee: International Business Machines Corporation, Armonk, N.Y.

[21] Appl. No.: 759,307

[22] Filed: Jan. 14, 1977

Related U.S. Application Data

[63] Continuation of Ser. No. 389,927, Aug. 20, 1973, abandoned, which is a continuation-in-part of Ser. No. 156,727, Jun. 25, 1971, abandoned.

[51] Int. Cl.[3] ..... G03G 13/10; G03G 13/24

[52] U.S. Cl. ..... 430/100; 430/118

[58] Field of Search ..... 427/15, 17; 96/12 Y; 252/62.12; 118/661, 662; 355/10; 430/100, 118, 126

[56] References Cited

U.S. PATENT DOCUMENTS

| | | | |
|---|---|---|---|
| 3,068,115 | 12/1962 | Gundlach | 427/17 |
| 3,512,965 | 5/1970 | Matkan | 96/12 Y |
| 3,885,960 | 5/1975 | Anderson | 427/16 |

FOREIGN PATENT DOCUMENTS

| | | | |
|---|---|---|---|
| 729134 | 3/1966 | Canada | 427/16 |
| 2009567 | 2/1970 | France . | |
| 45-41478 | 12/1970 | Japan . | |

*Primary Examiner*—Roland E. Martin, Jr.
*Attorney, Agent, or Firm*—Henry E. Otto, Jr.

[57] ABSTRACT

A process for the ink development of an electrostatic image comprising the steps:

(a) forming an electrostatic image on a charge retaining surface, (b) wetting the charge retaining surface with a thin layer of dielectric liquid which is chemically inert toward the surface, (c) inking the charge retaining surface with an electrically conductive liquid ink formulation which is immiscible with the dielectric liquid, (d) inducing at the interface between the ink and the dielectric liquid a charge differential with respect to the electrostatic image on the charge retaining surface, and, when the induced charge density at the dielectric liquid-oil interface exceeds a threshold value, (e) penetrating the dielectric liquid with the complete ink formulation, and (f) wetting the charge retaining surface with the ink formulation.

12 Claims, 6 Drawing Figures

INK DEVELOPMENT OF ELECTROSTATIC IMAGES

CROSS-REFERENCE TO RELATED APPLICATIONS

The present application is a continuation of copending application Ser. No. 389,927, filed Aug. 20, 1973, now abandoned, which in turn is a continuation-in-part of now abandoned application Ser. No. 156,727 filed June 25, 1971, now abandoned.

FIELD OF THE INVENTION

The present invention is concerned with a process for developing electrostatic images by means of ink development. In the past, development in transfer electrophotography has been carried on chiefly by means of dry toners. The use of dry toners requires fusing the dry toner image. Such fusing requires a considerable amount of heat energy. The process of the present invention overcomes this requirement, since little if any heat is required for drying. It also possesses the additional advantage of yielding background free development and is suitable for solid area development with good density. The process of the present invention is a simple one requiring only inexpensive equipment. It is adaptable for use at high speed, and can be applied to ordinary bond paper. It is especially suitable for use with systems employing reusable photoconductors.

PRIOR ART

U.S. Pat. No. 3,512,965 discloses the use of a "barrier substance" which in some instances may be a dielectric liquid. In contrast to the process of the present invention, the patent uses a development process which is dependent upon migration of charged particles in a dielectric medium, i.e., the development process of the patent may be characterized as electrophoretic, and it is image polarity dependent.

*The IBM Technical Disclosure Bulletin,* Vol. 10, No. 6, November 1967, at page 735 discloses an electrostatic copying process which employs a dielectric liquid. The process there disclosed, however, is one of powder development, and not ink development as in the present invention.

U.S. Pat. Nos. 3,068,115 and 3,368,894, and Canadian Pat. No. 729,134 each describe electrophoretic processes in which charged droplets of ink or toner particles held in a solid matrix are selectively electrostatically attracted. The process of the present invention differs from the process of these patents because in the present invention the same ink may be used both when the electrophotographic plate has been charged positively and when it has been charged negatively with the same end result, i.e., positive image. The present invention does not depend, as do these patents, on selective electrostatic attraction of charged droplets or toner particles.

SUMMARY OF THE INVENTION

According to the process of the present invention, the electrostatic image-bearing surface is wetted with a thin layer of dielectric liquid. It is preferred that the liquid have a conductivity of less than about $10^{-9}$ $ohm^{-1}$ $cm^{-1}$. There are many liquids suitable for this purpose. Particularly outstanding results have been obtained with liquid hydrocarbons, such as mineral spirit type liquids. Liquids of this type are available commercially under a variety of names and including such materials as kerosene, paraffin oil, ligroin, Sohio 3440, and the like. Mineral spirits characteristically have a low surface tension (25–28 dynes per cm), low viscosity and low density. Aliphatic hydrocarbons, such as hexane and heptane, are also suitable, as is cyclohexane. Very good results have also been obtained with silicone oils, for example, Dow-Corning DC 200. Fluorinated hydrocarbon liquids may also be used, for example, the Freons. Fluorinated ethers such as duPont's Freon E3, may be used. The dielectric liquid may also be a mixture of above materials.

The dielectric liquid should, of course, be chemically inert toward the particular type of electrostatic image bearing surface being employed in the process, i.e., there should be no chemical reaction which will impair the reusability of the surface. The present invention is suitable for use with any of the various types of electrophotographic plates currently used. Particularly good results have been obtained using organic photoconductive plates of the type shown in U.S. Pat. No. 3,484,237 of Shattuck and Vahtra. Binder type electrophotographic plates, such as those shown in U.S. Pat. Nos. 3,121,006 and 3,121,007 are also suitable for use in the present invention, and so are plates where the photoconductive material is selenium or an alloy of selenium. This invention is also suitable for use for development of electrostatic patterns on any dielectric surface, e.g., dielectric coated paper or metal.

It is preferable that the dielectric liquid be spread over the surface of the electrophotographic or electrostatographic plate in a thin layer. It is usually desirable that this layer be less than about 15 microns thick, and preferably less than about 5 microns thick.

It should be emphasized that the wetting of the electrostatic image-bearing surface with the liquid dielectric can be carried out either before, during, or after charging, and also before, during, or after formation of the electrostatic image. In like manner, the wetting may occur either before or during inking.

The usual way to form an electrostatic image is by charging an imagewise exposure to light of an electrophotographic plate surface. The charging step may be accomplished in any of the ways known to the art, for example, corona charging. The charging may be in either the positive or the negative mode. (This versatility is an additional advantage of the present invention.) In like manner, the imagewise exposure to light may be accomplished in any conventional manner. The electrostatic image may alternatively be formed by means of charging with a stylus, as is known in the art.

Inking may be conveniently carried out by any method of bringing the ink in contact with the wetted electrostatic image. Doctor blading, the use of a roller, and the use of an impression development member may all be employed for this purpose. A substantially embossed inked image can be observed on the plate. The plate is background free, and the inked image can easily be transferred, to a plain copy paper by direct contact, by pressure contact with a roller, or by corona transfer to the copy sheet.

The liquid ink development process of the present invention is believed to operate through an alteration of the interfacial surface energy between the dielectric liquid and ink layer. This change is interfacial energy is caused by inducing charge at the interface. In the absence of any charge at the interface between the dielectric liquid and ink, the interfacial surface area will be a minimum due to the surface tensions of the two immiscible liquids, or stated in an alternative manner, the interfacial surface energy is positive. Since a physical system will always seek the lowest energy configuration, the dielectric liquid-ink system will assume a configuration with minimum interfacial area. (This mechanism is discussed more fully below.)

Two characteristics result from the mechanism outlined above which clearly distinguish this process from the conventional electrophoretic development process usually referred to as liquid development. (1) Because the interfacial charge between the ink and dielectric liquid is *induced,* the process does not depend on the sign of charge on the photoconductor surface. This is not true of electrophoretic development where reversal of the developed image occurs when the latent electrostatic image charge changes in sign. (2) No inking of the photoconductor surface occurs until the induced charge density at the dielectric liquid-ink interface exceeds a threshold value. This results in a very abrupt increase in inked image density as a function of surface potential, as illustrated in FIG. 3 (discussed below). This effect is a distinct advantage of this type of development since the sharp threshold value for development insures extremely low background density. This characteristic is in sharp contrast to that observed for electrophoretic development where a very gradual (or low gamma) variation of developed image density vs. photoconductor surface potential occurs.

Figure 1:
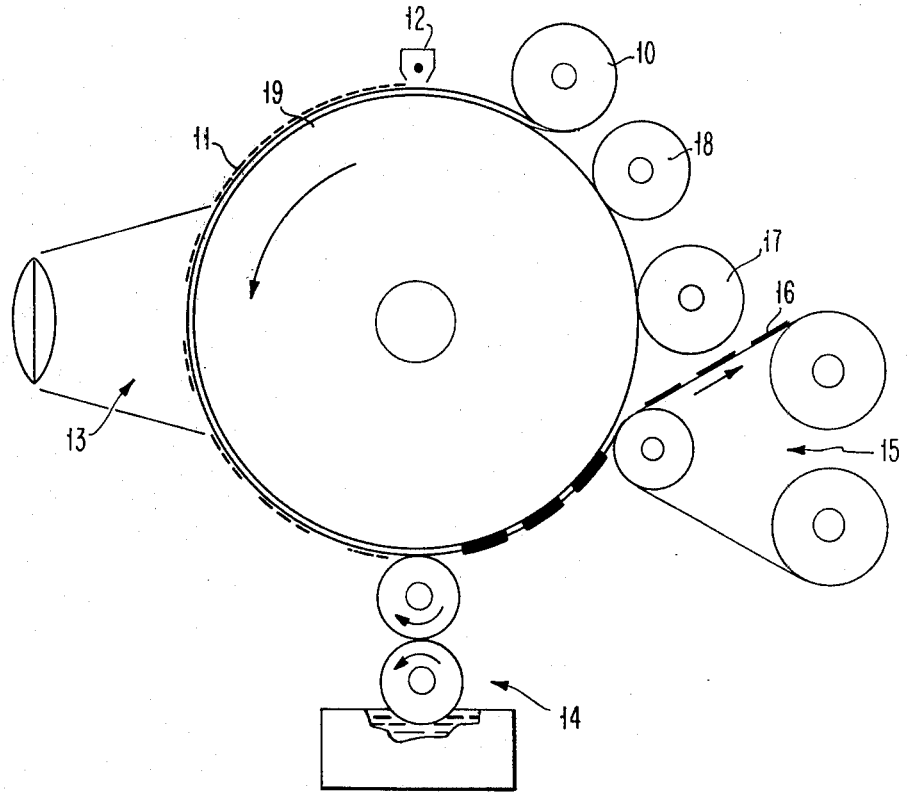
FIG. 1 (not to scale) illustrates one type of apparatus suitable for use with the process of the present invention.

Referring more particularly to FIG. 1, the electrophotographic plate has been shown in the form of a photoconductive drum 19. The dielectric liquid is supplied from a suitable wetting device 10 which deposits a film of dielectric liquid 11. The corona charging device is shown at 12. 13 represents a system for imagewise exposure, while ink applying means are shown at 14. 15 represents a transfer station from which the inked copy 16 emerges. A cleaning station is shown at 17, while 18 represents an erasing station.

The cleaning station 17, and the wetting station 10 may be combined.

A drying step, not shown in the drawing, may be included when desired.

Referring more particularly to FIG. 2, the electrophotographic plate has been shown in the form of photoconductor 20 on a conducting substrate 21. A film of dielectric liquid 11 is present on top of the photoconductor and a conducting ink film 22 has been applied over the dielectric liquid. The potential of the conducting ink film is controlled by means of a conducting development electrode 23 which is in contact with the ink.

The process through which the latent electrostatic image is developed by the ink is illustrated in FIG. 2. We consider first FIGS. 2*a* and 2*b* where it has been assumed that a grounded conducting electrode resides on top of the ink. This electrode can be, for example, the roller with which the ink is applied. A latent electrostatic image has been formed on the photoconductor surface such that the surface potential is $-V$ in the unexposed areas and substantially zero in the exposed areas. Due to the conductivity of the ink and the bias condition of the development electrode in areas where the surface of the photoconductor is charged, a charge is induced at the interface between the ink and the dielectric liquid as illustrated in FIG. 2*a*. The charges along the ink-dielectric liquid interface repel each other, but are unable to move laterally because they are *attracted* by the stationary charges on the photoconductor surface. The interfacial charges can become further separated from each other if ripples are created in the ink-dielectric liquid interface, but the tendency of the system to maintain minimum interfacial energy prevents ripples from occurring until the interfacial charge reaches a threshold density. Once this threshold charge density is exceeded, the minimum energy configuration of the system becomes one with maximum interfacial area so that the charges can be separated as much as possible. As illustrated in FIG. 2*b*, rippling of the interface occurs and the amplitude of the ripples increases rapidly so that the ink comes into contact with the photoconductor surface and wets it.

Figure 2A:
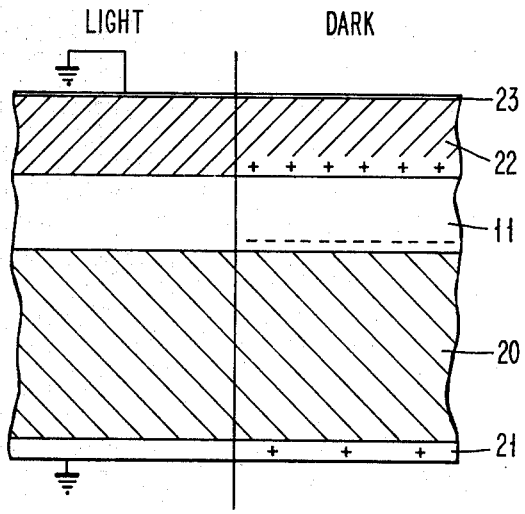
FIG. 2 (not to scale) illustrates the induced charge densities at the ink-dielectric liquid interface for two bias conditions and the resultant penetration of the complete ink formulation through the dielectric liquid.
Figure 2C:
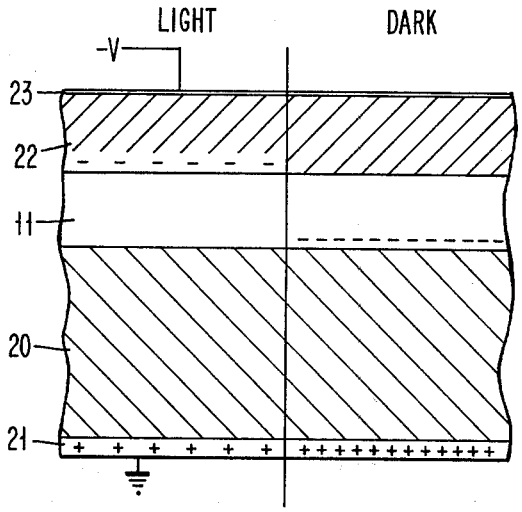
Figure 2B:
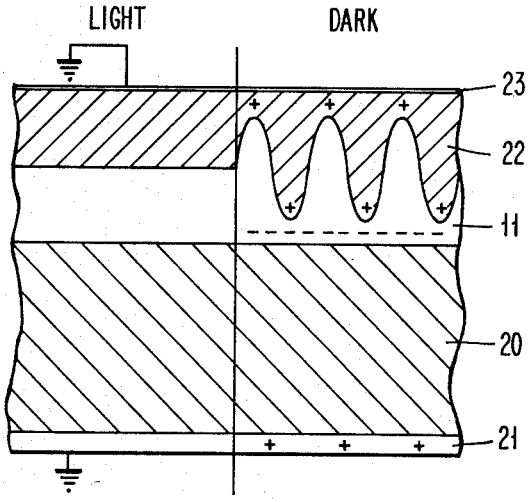
Figure 2D:
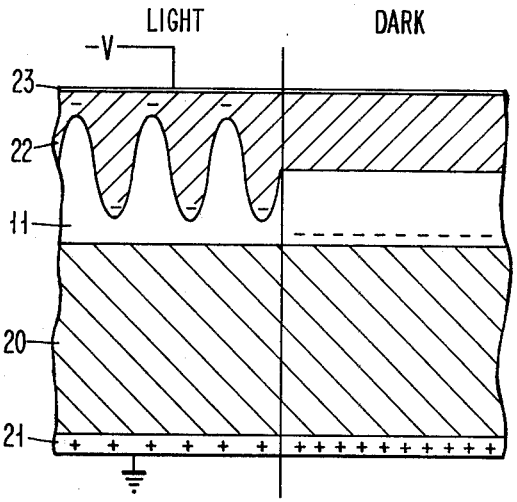

A variation of this process occurs if the conducting development electrode is biased to a potential of $-V$, as illustrated in FIGS. 2*c* and 2*d*. For this bias condition no charges are induced at the ink-dielectric liquid interface where the photoconductor is charged, but as illustrated in FIG. 2*c*, an induced charge appears at the ink-dielectric liquid interface in areas where no charge resides on the photoconductor. These induced charges are also mutually repulsive, but are unable to move along the ink-dielectric liquid interface because they are *repelled* by the stationary charges on the photoconductor surface. The same argument given above now applies, and the ink penetrates the dielectric liquid and wets the photoconductor surface once a threshold induced charge density has been exceeded. In this case the image obtained is the reverse of the image obtained when the development electrode is grounded.

Similar considerations to those discussed for the two cases above can be used to explain the effects of arbitrary bias conditions on the development electrode and different charge densities on the photoconductor surface. In particular, if the charge on the photoconductor in the exposed areas is non-zero, causing a potential V at the photoconductor surface, it may be desirable to set the bias on the development electrode to a potential V to reduce the background density developed in these areas.

Figure 3:
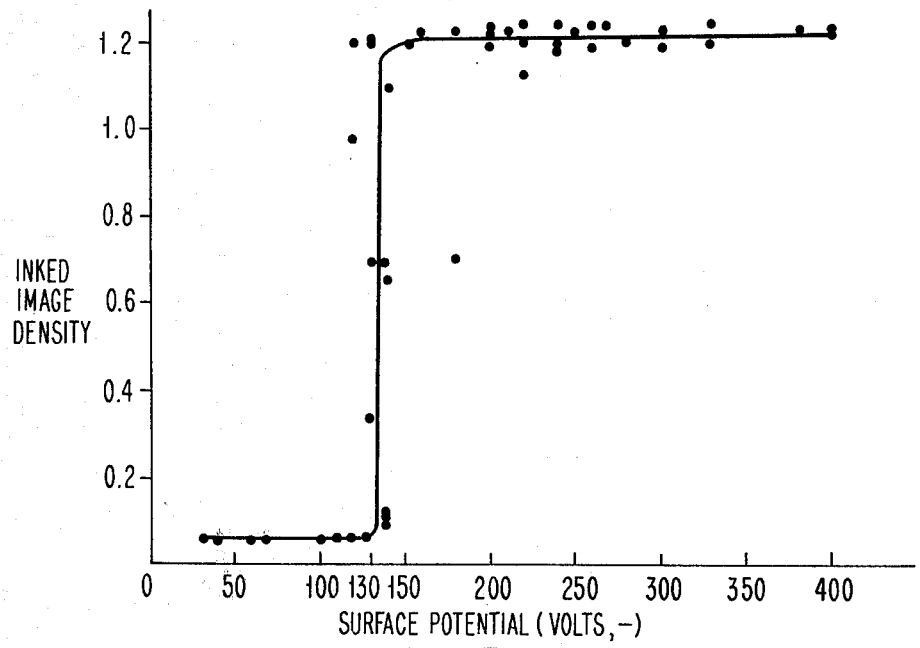
FIG. 3 is a plot of inked image density against surface potential.

Referring more particularly to FIG. 3, the surface potential in volts (negative charge) is plotted on the ordinate. On the abscissa there is plotted the inked image density. The experiment was conducted using a photoconductor prepared as described in U.S. Pat. No. 3,484,237. The dielectric liquid was mineral spirits and the ink was glycol based specifically Formulabs Black 587.

As may be seen from inspection of the figure the process of the present invention is characterized by a sharp threshold effect. There is a very abrupt change in the developed image density as a function of photoconductor surface potential. In FIG. 3, the threshold is at approximately 140 volts. It is obvious that the ink and the dielectric liquid may each be chosen for their surface energy property to shift this threshold charge density for development to any desired level. The voltage of 140 volts shown in FIG. 3 is a relatively low potential for producing development compared to some commercial processes such as magnetic brush or cascade development. This ability to use low voltages represents a still additional advantage of the present process.

It should be emphasized that the process of the present invention can use inks which are true solutions. This is in contrast to many liquid development processes employed in the past, where emulsions or dispersions were involved. Because inks of the present process can be true solutions, problems of emulsion stability are thereby avoided. It is believed that in the process of the present invention, the ink acts to displace the dielectric liquid film on the charge retaining surface.

The inks of the present invention are preferably made from a polar liquid with a dissolved dye. For improved cleaning of residual ink carbon black, pigments or both may be used in place of dye or in conjunction with it. Water, formamide, glycols such as ethylene glycol, and propylene glycol and the like are suitable liquids. It is essential that the ink be immiscible with the dielectric liquid.

In one particularly preferred variation of the present invention, the viscosity of the ink is increased by adding a small amount of water soluble thickening agent, such as hydroxy propyl methyl cellulose or the like. The best results are obtained where the ink has moderate to high surface tension for liquids and relatively high viscosity. It is also preferred that the ink have a dielectric constant greater than that of the dielectric liquid. It is believed that best results are obtained when the dielectric constant of the charge bearing surface in the dark is greater than that of the dielectric liquid.

In general, the ink roller or the inking member may be biased with a low DC field to minimize background development.

The general nature of the invention having been set forth, the following examples are now presented as to the specific preparation of preferred embodiments of the invention. The specific details presented are for purposes of illustration and not limitation.

EXAMPLE 1

A standard IBM organic photoconductor plate (see U.S. Pat. No. 3,484,237) is uniformly wetted with a thin layer of mineral spirits (Sohio 3440) charged in the dark with a corona emitting device to a surface potential of approximately −700 volts. The plate then is exposed to produce a latent electrostatic image having a contrast potential of approximately 400 volts (−500 volts in the image region, 100 volts in the background region). A layer of suitable ink, for example, Formulabs Black 587, is brought in contact with the image bearing, oil wetted surface, using an ink roller device. The plate may now be examined in the room light to observe an excellent black and white inked image which can be transferred with ease to a copy paper. The transfer can be accomplished either by direct contact to the receiving medium, by the aid of a flexible roller, or any other means. The plate now is ready to be cleaned and used for the next imaging cycle. The copy may either be heat dried or air dried.

EXAMPLE 2

The plate may be charged first, then wetted with dielectric liquid. The rest of the process is similar to Example 1, with good results obtained.

EXAMPLE 3

The wetting may be accomplished after imagewise exposure, instead of before, as in the previous examples. Good results are obtained.

EXAMPLE 4

The process of Example 1 was repeated except corona charging is positive. A positive inked image is observed.

EXAMPLE 5

The image potential of Example 1 can vary, from 150 volts on up, with background potential being lower than 150 volts. A positive image with good density and no background development is obtained.

EXAMPLE 6

When the dielectric liquid of Example 1 is replaced with the following liquids, inking of the image results in positive development: Isopar G (Humble Oil's isoparaffinic hydrocarbon, with a boiling range of 320°-350° F.), kerosene, ligroin, cyclohexane, hexane, heptane, fluorochemical FC-77 (a perfluorinated fluid from 3M Company), paraffin oil, silicon oil (DC200).

EXAMPLE 7

(a) The ink of Example 1 can be replaced with 0.2% solution of malachite green oxalate in water. A recognizable but poor inked image, composed of ink droplets, instead of a continuous solid line, is observed. Transfer of this liquid image to paper causes further image deterioration due to spreading of the low viscosity ink.

(b) The dye concentration of paragraph (a) above is increased to 5%-10%. A good inked image is obtained on the liquid dielectric wetted surface of the plate in Example 1. However, due to its low viscosity, smearing is observed in the transfer process.

(c) To the solution of paragraph (b) above, a thickening agent is added. For example, methocel (hydroxy propyl methyl cellulose) to increase the ink viscosity in the range of 5,000 to 10,000 cps. Very definite improvement in image smearing is observed.

EXAMPLE 8

The ink of Example 1 can be replaced with the following inks and good inked image can be observed. These inks are all commercially available ball point pen inks from Formulabs: (Green) M-51, (Red) M-52, Gold 572, Green 295, Turquoise 646, Blue 353, Brown 218, Blue 160.

EXAMPLE 9

The dye of ink solution of Example 7(c) can be replaced with other water soluble dyes. The following are examples: Cyper Black LA, Methylene Blue, Naphthylene Black 10BR, Alizarine Blue Black, Crystal Violet, Nyliton Black, Palanthrene Blue BA, Mordant Blue B.

Solutions of 5% of each of the above dyes in water were prepared and the ink roller of Example 1 was replaced with a doctor blade for inking of the image. Good inked images were obtained on the photoconductor.

EXAMPLE 10

The ink of Example 1 was replaced with two well-known low viscosity inks, each of which resulted in inked image development; in this example, the doctor blade of Example 9 was used. The two inks are:

(1) A. B. Dick video jet (2) Schaeffer Skrip #62 ink

EXAMPLE 11

The ink roller of Example 1 was biased with 400 volts DC field. Reversal image development was obtained.

What is claimed is:

1. A process for the ink development of an electrostatic image on a charge retaining surface on an imaging member for the purpose of subsequent transfer therefrom to a copy medium, said process comprising the steps of:

(a) wetting the charge retaining surface with a continuous film of a dielectric liquid that is less than about 15 microns thick and is chemically inert toward said surface, (b) applying to said surface an electrical potential of optional polarity but predetermined magnitude, (c) forming on said surface an electrostatic latent image comprising charged and uncharged image areas to create a contrast potential of at least a predetermined magnitude therebetween, (d) applying with a roller to the wetted surface at said charged and uncharged image areas as a continuous thin film an electrically conductive liquid ink that contains no selectively depositable charged particles and is immiscible with the dielectric liquid, thereby to create by virtue of the magnitude of said contrast potential, an induced charge differential which exceeds a preselected threshold value at the interface between the ink and dielectric liquid, selectively at the charged or uncharged image areas on said surface according to whether an electrical bias potential of appropriate sign and magnitude is not or is, respectively, applied to the ink by way of said roller, which charge differential causes the electrically conductive ink (i) to displace the dielectric liquid and thus cause all constituents of which the ink consists to selectively wet only the image areas subjected to said induced charge differential, and (ii) to be completely repelled by the dielectric liquid in the areas not subjected to said charge differential, whereby an image is formed as a result of the magnitude of the induced charge differential across said interface, without precharging of said ink and independent of the polarity of the said electrical potential.

2. The process according to claim 1, wherein said ink has the same formulation for positive or negative imaging.

3. The process according to claim 1, wherein the step (a) follows step (b).

4. The process according to claim 1, wherein the step (a) follows step (c).

5. The process according to claim 1, wherein the continuous layer of dielectric liquid is applied by a roller in step (a).

6. The process according to claim 1, including the further step of transferring the ink only from the selectively wetted image areas to a copy medium that is untreated ordinary bond paper.

7. The process according to claim 1, wherein said dielectric liquid has a conductivity of less than about $10^{-9}$/ohm cm.

8. The process according to claim 1, wherein said predetermined magnitude need only exceed about 150 volts, positive or negative.

9. The process according to claim 1, wherein the ink is formulated from a polar liquid with a dissolved dye, and has a viscosity of the order of about 5,000 to 10,000 cps to minimize smearing, and a dielectric constant greater than that of the dielectric liquid.

10. A process for the ink development of an electrostatic image comprising the steps of:

(a) wetting a charge retaining surface on an imaging member with a continuous film of dielectric liquid that is less than about 15 microns thick and is chemically inert toward said surface, (b) applying to said surface an electrical potential of optional polarity but predetermined magnitude to cause a charge to be retained thereon, (c) forming on said surface an electrostatic latent image comprising charged and uncharged image areas to create a contrast potential of at least a predetermined magnitude therebetween, (d) coating the charged and uncharged image areas of the wetted surface with a thin continuous film of an electrically conductive liquid ink that contains no selectively depositable charged particles and is immiscible with the dielectric liquid, so as to create, as a result of the magnitude of said contrast potential, an induced charge differential which exceeds a preselected threshold value at the interface between the ink and dielectric at the charged image areas, which charge differential causes the electrically conductive ink to displace the dielectric liquid and thus cause all constituents of which the ink consists to selectively wet only the charged image areas of said surface, and (e) transferring the inked image from the imaging member to a copy medium to provide a positive image thereon, said positive image being provided irrespective of whether said charge retaining surface is charged positively or negatively in step (b).

11. The process according to claim 10, including the further step of:

(f) applying an electrical bias potential of appropriate size and magnitude to said ink to prevent an induced charge differential from being created at the ink-dielectric liquid interface at said charged image areas, but cause a charge differential to be induced at said interface at the uncharged areas, thereby to provide a negative image, the formulation of said ink being identical for positive or negative imaging.

12. The process according to claim 11, wherein steps (d) and (f) are performed concurrently.

* * * * *